US005807220A

United States Patent [19]

Allis et al.

[11] Patent Number: 5,807,220

[45] Date of Patent: Sep. 15, 1998

[54] DEVICE FOR PROTECTING NECK AND UPPER BACK DURING ABDOMINAL EXERCISES

[76] Inventors: Robert A. Allis; Shelly M. Allis, both of 1389 Sawleaf Ct., San Luis Obispo, Calif. 93401; Thomas A. Baird, 237 Murray Ave., Ann Arbor, Mich. 48103

[21] Appl. No.: 647,708

[22] Filed: May 14, 1996

[51] Int. Cl.[6] ..... A63B 23/02

[52] U.S. Cl. ..... 482/140; 482/131; 482/139

[58] Field of Search ..... 482/10, 95, 131, 482/132, 140, 139, 142, 148; 602/19; 601/39; 606/240; 5/636, 637, 643; 128/869, 870; D21/191, 193; D24/191

[56] References Cited

U.S. PATENT DOCUMENTS

| | | | |
|---|---|---|---|
| 16,300 | 12/1856 | Wilson . | |
| 138,463 | 4/1873 | Wright . | |
| D. 321,386 | 11/1991 | Reichman | D21/191 |
| D. 323,218 | 1/1992 | Kamensky | D24/191 |
| D. 325,087 | 3/1992 | Brinker | D24/191 |
| D. 337,824 | 7/1993 | Campbell | D24/191 |
| 357,915 | 2/1887 | Ferry . | |
| 392,212 | 11/1888 | McCollum . | |
| 1,301,276 | 4/1919 | Kroetz . | |
| 2,796,866 | 6/1957 | Cohen . | |
| 3,055,358 | 9/1962 | Palma et al. . | |
| 3,522,804 | 8/1970 | Towbin | 128/869 |
| 3,810,466 | 5/1974 | Rogers . | |
| 3,921,626 | 11/1975 | Neel . | |
| 4,226,231 | 10/1980 | Anderson | 128/870 |
| 4,299,211 | 11/1981 | Doynow | 128/870 |
| 4,589,407 | 5/1986 | Koledin et al. | 128/869 |
| 4,752,067 | 6/1988 | Colonello | 482/140 |
| 4,863,158 | 9/1989 | Tassone . | |
| 5,122,107 | 6/1992 | Gardner | 482/140 |
| 5,169,372 | 12/1992 | Tecco . | |
| 5,267,931 | 12/1993 | Faetini . | |
| 5,295,949 | 3/1994 | Hathaway . | |
| 5,435,563 | 7/1995 | Salvatore | 128/870 |

FOREIGN PATENT DOCUMENTS

| | | | |
|---|---|---|---|
| 3326078 | 1/1985 | Germany | 482/140 |

*Primary Examiner*—Jeanne M. Clark
*Attorney, Agent, or Firm*—Price, Heneveld, Cooper, DeWitt & Litton

[57] ABSTRACT

An exercise device for use in exercising the abdominal muscles by performing sit-ups, which device protects the neck and upper back while the user performs such exercises.

10 Claims, 2 Drawing Sheets

IV
16a
17
13a
10a
12
21a
1a
20a
22a
14a
IV 16a
21a
22a

DEVICE FOR PROTECTING NECK AND UPPER BACK DURING ABDOMINAL EXERCISES

FIELD OF THE INVENTION

The present invention relates to an exercise device for use in exercising the abdominal muscles, such exercise being generally referred to as performing sit-ups, curls, or crunches. More particularly, this invention relates to a device used to protect the neck and upper back while the user performs such abdominal exercises.

BACKGROUND OF THE INVENTION

Sit-ups are the most commonly used exercise to strengthen the abdominal muscles. The traditional method of performing sit-ups is for the exerciser to place the hands behind the head or neck, or cross the arms over the chest. In performing the trunk raising (curl) phase of the exercise, the neck is pulled away from its normal postural alignment and to its end range of motion in flexion—from the upper cervical spine to the upper thoracic spine. While this area (head, neck, upper back) must be raised in order to cause the abdominal muscles to work, the forceful pulling of the area to its end range of motion can cause injury. Most commonly, the lower cervical spine, or the Cervicothoracic junction are injured or aggravated by the repetitive flexion motion of sit-ups or crunches. In some settings, the exerciser is warned against pulling the chin down to the chest (flexing the neck and upper back), and the exerciser will then attempt to raise the trunk without the neck flexion. The result is protraction, or a head forward motion involving flexion specifically at the Cervicothoracic junction and upper back, with hyperextension of the upper-cervical spine. This may be more harmful to the health of the neck than the previous example, as lifestyle and postural habits tend to place the same type of stress on this area, thereby setting it up as an easy target for injury due to the repetitive additional stress involved in performing abdominal exercises.

The abdominal muscles are attached to the bones and fascia of the anterior trunk: ribs, sternum, and pelvis. If a person has very weak abdominal muscles, they will be unable to actively raise their head up (flex the cervical spine) in a lying down (supine) position due to lack of stabilization from the trunk. Therefore, it is easy to see that the neck and abdominal muscle groups are closely interrelated. Further, a person who may have a neck injury from any cause, will be unable to perform traditional abdominal exercises without aggravating their condition.

We have conceived that in order to protect the cervical and upper thoracic spines from injury caused by repetitive flexion or protraction, a device must stabilize the spine down to the level of the upper most attachments of the abdominal muscles. This would be to approximately the level of the fifth thoracic vertebra (mid to lower shoulder blade). Stabilized to this level, the entire portion of the spine at risk for injury will be protected, and the efficiency of the abdominal muscles will be enhanced by the increased stability of the body segment they are attempting to move.

Previous devices have attempted to enhance abdominal exercise by adding resistance (Tecco, U.S. Pat. No. 5,169,372), or to protect the biomechanical integrity of the cervical spine during abdominal exercise (Faetini, U.S. Pat. No. 5,267,931), or to support the head by applying the pull force on the head to the back and sides (Gardner, U.S. Pat. No. 5,122,107), all of these devices fail to encompass the upper thoracic spine, and thereby do not maximize the goals they state. The Faetini device only protects the middle cervical spine, and does not protect the lower cervical spine, Cervicothoracic junction, or the upper cervical spine in the cervico-occipital junction. Those areas are at greater risk of injury from abdominal exercises, especially when protraction occurs. The Tecco and Gardner devices also fail to stabilize the entire body segment lifted by the abdominal muscles; therefore resulting in an inefficient/ineffective crunch or sit-up. No device is known which protects the neck and upper back while doing abdominal exercises.

SUMMARY OF THE INVENTION

Our invention overcomes the problems discussed above by providing a biomechanically contoured rigid support for the head, neck, and upper back in order to reduce the repetitive strain on the joints and soft tissues incurred while performing abdominal exercises. This contoured support creates a single biomechanical segment for the abdominal muscles to move. It thereby insures efficiency and reduces extraneous motions of the head, neck, and upper back.

More specifically, our invention provides a rigid contoured member having a head section for cradling the head, a neck section for supporting the cervical curve, and a back section for extending under and supporting the upper back. The head, neck, and back sections are interconnected and contoured to substantially match the normal biomechanical alignment of the head, neck, and upper back of an individual. This rigid contoured member is attached to the back section of the exerciser for holding the member to the back. A handle is provided on each side of the neck section for the exerciser to grasp and pull to exert a lifting force at the level of the base of the user's skull. The lightweight contoured member matches the normal biomechanical alignment of the head, neck, and upper back and is designed to be placed behind these areas so that when the user exerts a pull at the level of the base of the skull and in performing a sit-up, the abdominal muscles of the user moves the head, neck, and upper back in a single biomechanical segment while maintaining the alignment of the head, neck, and upper back. This simultaneous movement of the head, neck and upper back protects the cervical and upper thoracic spine from injury caused by repetitive flexion or protraction by reason of the device stabilizing the spine down to the level of the uppermost attachments of the abdominal muscles. Stabilization to approximately the level of the fifth thoracic vertebra (mid to lower shoulder blade) prevents the risk of injury to this entire portion of the spine. Further, the efficiency of the abdominal muscles are enhanced by the increased stability of the body segment they are attempting to move.

In a more specific aspect of this invention, a pivot point is provided on the back surface of the exerciser device. This pivot point molded to the bottom/base portion of the device allows for movement in a diagonal plane allowing diagonal/oblique sit-ups to be performed.

Having briefly described our invention, a better understanding of it will be obtained by the following detailed description in conjunction with the appended drawings.

DETAILED DESCRIPTION OF THE INVENTION

Figure 1:
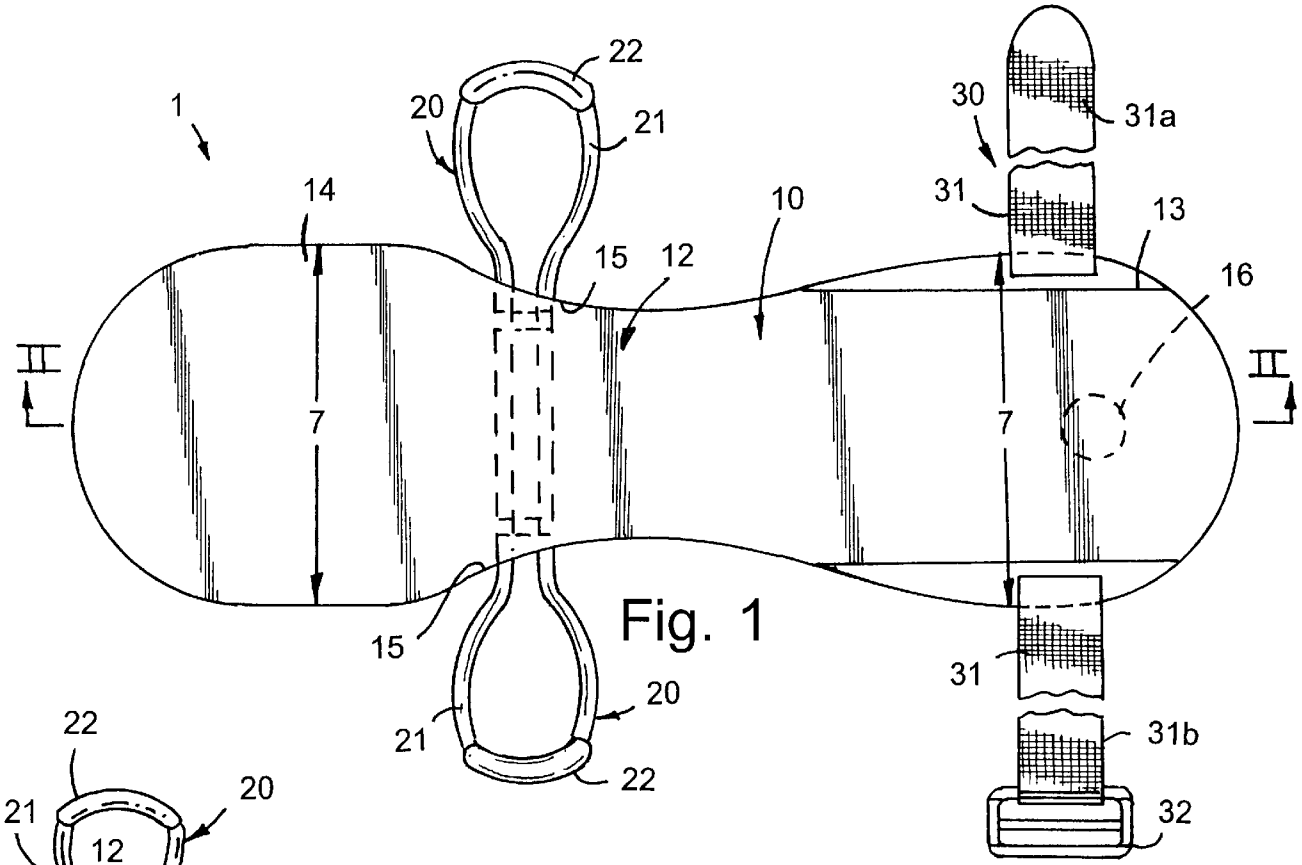
FIG. 1 is a plan view of the exerciser device of this invention.

Referring to the drawings, reference numeral 1 designates the exerciser device including the contoured panel 10, the handles 20, and the support straps 30.

Contoured panel 10 includes a headrest section 11, a contoured neck support section 12, and a back section 13, preferably all molded together in one piece to form a rigid or semi-rigid material. Preferably, the panel member 10 is molded of a lightweight rigid plastic material such as a polycarbonate, epoxy resin, or machine resin, so as to support the head, the neck, and a portion of the back extending into the thoracic spine of the user. The panel member 10 should be sufficiently rigid to essentially maintain the contoured shape while the user is performing sit-ups. It should be understood in the use of "rigid" throughout this application is meant that the panel will substantially maintain it contoured shape during the user performing a sit-up.

The headrest section is curved gently to cradle the head of the normal user. It is preferably padded with a lightly padded foam padding 14 or the entire panel 10 is encapsulated with a thin-closed cell padding. Headrest section 11 merges with the neck support section 12, which also can be lightly padded. The contoured neck section 12 is contoured to the biomechanical/anatomic curves of the spine so as to maintain and support the neutral anatomical alignment of the cervical spine. The neck section extends from approximately point 12*a* to 12*b* as disclosed in FIG. 2. The back or base section 13 merges with neck portion 12 at approximately the point 12*b* and extends essentially along a straight plane a distance to the average normal mid thoracic spine of the user. Back section 13 widens out and have a rounded end as viewed in FIG. 1.

Panel 10 can be sized and contoured to fit the average person, it being understood that the exact size and contour is not critical to the basic concept of this invention. For the average person, contoured panel 10 measures approximately 20–22 inches in length, is 7 to 8 inches wide across headrest section 11 and back section 12, and is 4 inches wide across the neck support section 12. It should also be understood that panel 10 could be molded to conform exactly with an individual user so as to be custom made for such user.

Handle 20 is preferably constructed of elastic tubing 21 extending from the sides of the neck support section 12 so as to form loops as disclosed in FIG. 1. Handle grips 22 cover the end of the loops 21. Preferably, grips 22 are formed of a soft material such as foam so as to protect the hands of the user. Handles 20 extend approximately 5–7 inches from each side 15 of the neck support section 12. As disclosed in FIG. 2, the mid section of the handles 20 are secured in the back surface of the neck support section 12. This is accomplished by glue or other adhesive material.

The support straps 30 comprise fabric straps 31 extending from the sides of the back section at its lower end. Straps 31 can be constructed of many different materials such as nylon. The straps 31 are provided at the ends 31*a* and 31*b* with the means for connecting the two, such connecting means being adjustable for accommodating different sizes of the user. As disclosed, end 31*b* includes a metal or plastic fastener 32 through which the end 31*a* can be threaded through and attached. Other fastener means such as Velcro® type fasteners can be utilized so long as the ends 31*a* and 31*b* can be easily disconnected and connected together. The support straps 30 are optional. Primarily they are used to stabilize the back section 13 if needed.

Within a narrow aspect of this invention, we provide a means which allows the user to move in a diagonal plane so as to perform so called diagonal/oblique sit-ups. This is accomplished by providing a rounded pivot protrusion 16 located on the central axis of the contoured panel 10 and at the lower end of the back section 13. This protrusion is molded into the back surface of the plastic panel 10 approximately 2½ inches from the end of the back section 13. It has a semi-spherical shape and is approximately ½ inch in height and in diameter. It permits the user to move in a diagonal plane so as to perform a diagonal/oblique sit-up.

Figure 2:
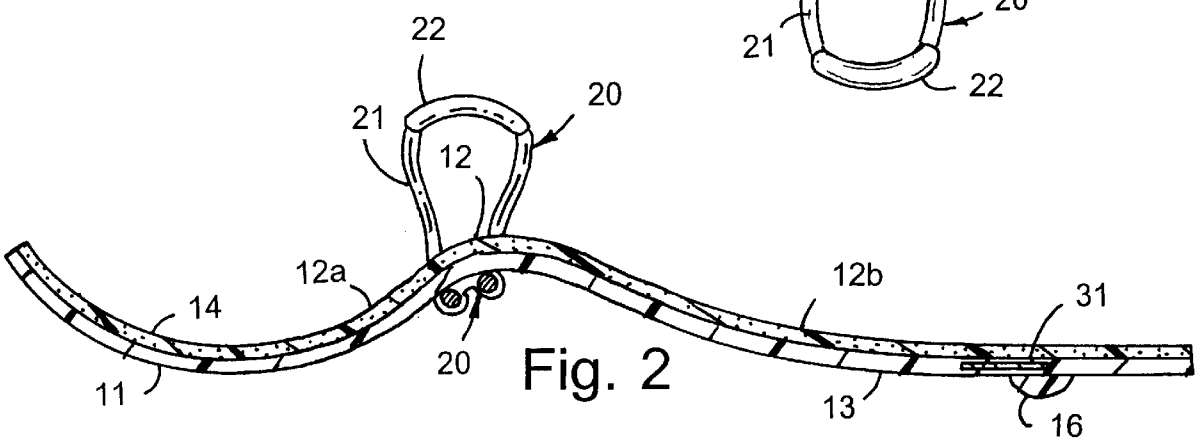
FIG. 2 is a cross-sectional view taken along the plane II—II of FIG. 1.
Figures 3, 4, 5, 6A, 6B, 6C:
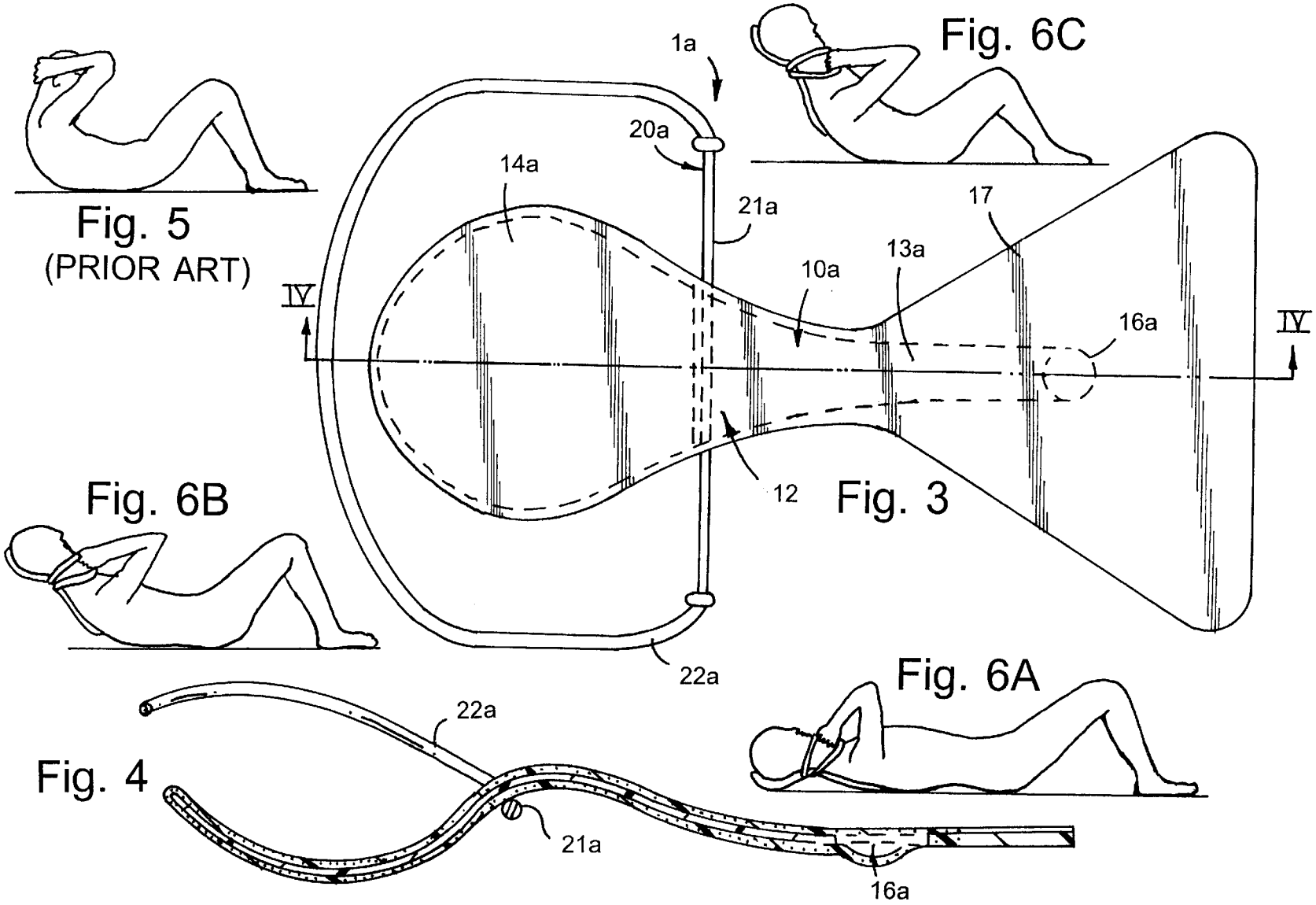
Fig. 5 (PRIOR ART)
FIG. 3 is a plan view of another embodiment of the exerciser device of this invention.
FIG. 4 is a cross-sectional view taken along the plane IV—IV of FIG. 3.
FIG. 5 is a side elevational view of a person performing a sit-up without using the exerciser device of this invention.
FIGS. 6*a*, 6*b*, and 6*c* are side elevational views of a person performing a sit-up using the exerciser device of this invention.

FIGS. 3 and 4 discloses a more sophisticated second embodiment of my invention which is quite similar to that disclosed in FIGS. 1 and 2. Therefore, it is considered only necessary to describe the differences. First difference is in the specific shape of the panel or panel member 10*a*. It will be noted that the head section 14*a* is essentially the same dimensions as that of FIGS. 1 and 2. The neck section 12 also is essentially the same width. The primary difference in the configuration of the panel member 10*a* is that the back section 13*a* tapers down to a width of from 2 to 3 inches which is sufficient to cover the spine and support the same. Also, the entire panel 10*a* is encapsulated in a thin layer of high density closed-cell foam such as neoprene which fans out from the back section 13*a* to produce the fanned out section 17 that will conform more nearly to the shape of the back of the user, and provide greater stabilization of the device underneath the user.

Another difference in the exerciser of FIGS. 3 and 4 from that of the exerciser of FIGS. 1 and 2 is the construction of the handle 20*a* which includes the rigid elongated member 21*a* such as a dowel attached under the contoured neck section 12. A padded continuous strap 22*a* is secured to and extends from each of the ends of the dowel 21*a* to provide a hand grip.

The embodiment of FIGS. 3 and 4 also includes the rounded pivot point 16*a* molded into the plastic of the panel member 10*a*. This rounded pivot point 16*a* is located at the end of the back section 13*a* and constitutes the final 1½ inches of the back section. It is approximately ¼–½ inch in height. It permits the user to move in a diagonal plane so as to perform a diagonal/oblique set up. The embodiment of FIGS. 3 and 4 may optionally include a support strap such as strap 30 of FIGS. 1 and 2.

OPERATION

Having described our exerciser device, the use of it should be evident. Such use is accomplished by lying on top of the panel 10 such that the back of the head is cradled in the headrest section 14 and the neck is supported by the contoured neck section 12 as disclosed in FIG. 6*a*. As previously stated, the user may optionally attach the support straps 30 around his chest so as to hold and stabilize the back section 13 against the back. In this position, the back portion 13 extends to the midthoracic spine of the user.

The user then grasps the handle grips 22 and pulls and supports the head, neck and the back while performing the sit-up. The abdominal muscles in performing the sit-up will pull the head, neck, and upper portion of the back as a single biomechanical segment upwardly as viewed in FIGS. 6*b* and 6*c*. Such movement is in contrast to the performance of a sit-up by a user as illustrated by FIG. 5. Preferably, as the user exerts a force on handles 20, such force is sufficient only to lift the head and hold the panel 10 against the head, neck, and back. This is accomplished by the resilient tubes 21 being made of a material that would stretch after the weight of the head is exceeded by the pull of the user so that the pull does not assist in the sit-up but such sit-up is accomplished solely by the abdominal muscles.

If the user desires to perform a diagonal/oblique sit-up, the rounded pivot protrusion 16 permits the same.

The use of the embodiment as disclosed in FIGS. 3 and 4 is essentially the same as the use above described with relation to FIGS. 1 and 2. In other words the exerciser 1*a* is used by lying on top of the device such that the back of the head is cradled in the head rest 14*a* and the neck is supported by the contoured neck section 12. The back section 13*a* and the fanned out section 17 lies under the back of the user. The user then grasps the padded strap on the other side of the head, anywhere along the length of the strap, or with one hand in the center over the face, and performs an abdominal curl while holding the device snugly against his head and neck. In such use, the proper neck and upper back postural alignment will be maintained and efficiency gained by employing this invention.

Having described the details and the operation of our exerciser, it should become evident that the proper neck and upper back postural alignment will be maintained so as to protect the cervical and upper thoracic spines from injury caused by repetitive flexion or protraction generally experienced in performing sit-ups. Further, the exercise of the abdominal muscles are enhanced because of the efficiency gained by employing the present invention.

Although our invention has been described in its preferred embodiment, it should become clear that modifications are possible within the ability of those skilled in the art without departing from the spirit of the invention. Accordingly, the scope of the invention is defined in the following claims.

The embodiments of the invention in which an exclusive property or privilege is claimed are defined as follows:

We claim:

1. A device for use by a person in performing an abdominal sit-up, crunch or curl comprising:

a rigid contoured member having a curved concave headrest section adapted for cradling the head of a person, a curved convex neck section adapted to be contoured to the biomechanical/anatomic curves of the spine for supporting the alignment of the cervical spine of a person, and a slightly concaved back section merging with said neck section adapted for extending under and supporting the upper back of a person, said head, neck, and back sections being interconnected and contoured and adapted to substantially match the biomechanical alignment of the head, neck, and upper back of a person;

a handle on each side of said neck section;

said handles being provided by an elongated rigid member secured under the neck section and extending lengthwise a lateral distance from each side of said neck section;

and a hand grip secured to each of the ends of said elongated rigid member.

2. The device of claim 1 in which said back section sized and configured to extend down the back of a person into the thoracic spine.

3. The device of claim 2 in which the surface of said back section opposite the surface that engages the back of a person includes a rounded portion allowing diagonal/oblique sit-ups to be performed.

4. The device of claim 1 in which the surface of said back section opposite the surface that engages the back of a person includes a rounded portion allowing diagonal/oblique sit-ups to be performed.

5. The device of claim 4 in which said rounded portion is a rounded pivot point.

6. The device of claim 1 in which a high density foam mat extends below and fans out from the back section.

7. A device for use by an individual in performing an abdominal sit-up or curl comprising:

a rigid contoured member having a curved concave headrest section adapted for cradling the head of a person, a curved convex neck section adapted to be contoured to the biomechanical/anatomic curve of the spine for supporting the alignment of the cervical spine of a person, and a slightly concaved back section merging with said neck section adapted for extending under and supporting the upper back of a person, said head, neck, and back sections being interconnected and contoured and adapted to substantially match the biomechanical alignment of the head, neck, and upper back of a person;

a handle on each side of said neck section;

said handles being provided by an elongated rigid member secured under the neck section and extending on each side thereof;

and a hand grip secured to each of the ends of said elongated rigid member.

8. In a device for use by an individual in performing an abdominal sit-up, crunch or curl comprising:

a rigid contoured member having a curved concave head section adapted for cradling the head of a person, a curved convex neck section adapted to be contoured to the biomechanical/anatomic curves of a spine for supporting the cervical spine of a person, and a slightly concaved back section merging with said neck section and adapted for extending under and supporting the upper back of a person, said back section having a substantially narrow rigid portion of a reduced width as compared to said head and neck sections but being sufficiently wide to support the midthoracic spine of a person, said head, neck, and back sections being one piece and adapted to be contoured to substantially match the biomechanical alignment of the head, neck, and upper back of a person; said back section including a fanned out section provided below and to the sides of said narrow rigid portion.

9. The device of claim 8 in which a handle is provided on each side of said neck section.

10. The device of claim 9 in which each of said handles extends a distance from a side edge of said neck section, and said handles include hand grips.

* * * * *